US006592772B2

(12) United States Patent
Foister et al.

(10) Patent No.: US 6,592,772 B2
(45) Date of Patent: Jul. 15, 2003

(54) STABILIZATION OF MAGNETORHEOLOGICAL FLUID SUSPENSIONS USING A MIXTURE OF ORGANOCLAYS

(75) Inventors: Robert T. Foister, Rochester Hills, MI (US); Vardarajan R. Iyengar, Pontiac, MI (US); Sally M. Yurgelevic, Eastpointe, MI (US)

(73) Assignee: Delphi Technologies, Inc., Troy, MI (US)

( * ) Notice: Subject to any disclaimer, the term of this patent is extended or adjusted under 35 U.S.C. 154(b) by 49 days.

(21) Appl. No.: 10/015,981

(22) Filed: Dec. 10, 2001

(65) Prior Publication Data

US 2003/0111634 A1 Jun. 19, 2003

(51) Int. Cl.[7] ..... H01F 1/44
(52) U.S. Cl. ..... 252/62.52
(58) Field of Search ..... 252/62.52

(56) References Cited

U.S. PATENT DOCUMENTS 6,132,633 A 10/2000 Carlson ..... 252/62.52
6,203,727 B1 3/2001 Babinec et al. ..... 252/62.52

*Primary Examiner*—C. Melissa Koslow
(74) *Attorney, Agent, or Firm*—Scott A. McBain

(57) ABSTRACT

A magnetorheological fluid formulation comprising magnetizable particles dispersed in a multi-component liquid vehicle comprising an organoclay stabilization mixture. At least one organoclay is selected for each liquid vehicle component, each organoclay having a surface chemistry that renders it preferentially compatible with the surface functionality of one of the liquid components relative to its compatibility to the remaining components whereby it is effective to stabilize, or gel, that component. A method of making an MR fluid is also provided in which liquid vehicle components are blended together, the organoclay mixture is added to the blend, and magnetizable particles are suspended therein, resulting in a stable MR fluid of suitable viscosity and yield stress.

31 Claims, 1 Drawing Sheet

STABILIZATION OF MAGNETORHEOLOGICAL FLUID SUSPENSIONS USING A MIXTURE OF ORGANOCLAYS

FIELD OF THE INVENTION

This invention relates to magnetorheological fluids.

BACKGROUND OF THE INVENTION

Magnetorheological (MR) fluids are substances that exhibit an ability to change their flow characteristics by several orders of magnitude and in times on the order of milliseconds under the influence of an applied magnetic field. These induced rhleological changes are completely reversible. The utility of these materials is that suitably configured electromechanical actuators which use magnetorheological fluids can act as a rapidly responding active interface between computer-based sensing or controls and a desired mechanical output. With respect to automotive applications, such materials are seen as a useful working media in shock absorbers, brakes for controllable suspension systems, vibration dampers in controllable power train and engine mounts and in numerous electronically controlled force/torque transfer (clutch) devices.

MR fluids are noncolloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. At the present state of development, MR fluids appear to offer significant advantages over other types of controllable fluids, such as ER fluids, particularly for automotive applications, because the MR fluids are relatively insensitive to common contaminants found in such environments, and they display large differences in rheological properties in the presence of a modest applied field.

A typical MR fluid in the absence of a magnetic field has a readily measurable viscosity that is a function of its vehicle and particle composition, particle size, the particle loading, temperature and the like. However, in the presence of an applied magnetic field, the suspended particles appear to align or cluster and the fluid drastically thickens or gels. Its effective viscosity then is very high and a larger force, termed a yield stress, is required to promote flow in the fluid.

Because MR fluids contain noncolloidal solid particles which are at least five times more dense than the liquid phase in which they are suspended, suitable dispersions of the particles in the liquid phase must be prepared so that the particles do not settle appreciably upon standing nor do they irreversibly coagulate to form aggregates. Without some means of stabilizing or suspending the solid, sedimentation and/or flow induced separation of the solid phase from the liquid phase will occur. Such separation will have a drastic and detrimental effect on the ability of the MR fluid to provide optimal and repeatable performance.

The magnetizable particles are kept in suspension by dispersing a thixotropic agent in the liquid vehicle. There are basically two approaches to the stabilization of MR fluids: the use of polymeric thickeners, such as high molecular weight hydrocarbons, polyureas, etc., or the use of a finely divided solid, such as fumed silica or colloidal clay.

Essentially, both approaches aim to prevent separation of the liquid and solid phases by forming a thixotropic network which "traps" or suspends the heavier solid in the lighter liquid. Of these two methods, the use of polymeric thickeners in MR fluids can be problematical, since it is difficult to achieve sufficient stability against settling without using an amount of thickener which will impart a grease-like consistency to the composition. Although sedimentation or settling is minimized, the MR fluid is no longer free flowing, and in fact, may exhibit an unacceptably high viscosity.

An alternative to polymeric thickeners is fumed silica. It has been demonstrated in the prior art that fumed silica can be used as a stabilizer in MR fluid compositions, provided attention is given to the selection of fumed silica grades that are compatible with the chemistry of the liquid phase. This selection is complicated by the fact that the liquid phase is often a combination of miscible, but chemically different materials. If adequate shear mixing is achieved in processing, a lightly gelled system can be formulated using fumed silica. Although characterized by a "yield stress" (defined as the applied force/area required to initiate flow) sufficient to prevent settling, it has been shown that such a system will still flow with a moderate to low viscosity. However, one perceived disadvantage in using fumed silica is that this material, even in amounts less than two or three percent/volume, can cause the MR fluid to be abrasive towards polymeric seals as well as metallic wear surfaces in the device. This is particularly detrimental in vehicle damper applications, where a considerable amount of expense and effort has been devoted to providing wear-resistant coatings, for example, to protect the damper from failure due to excessive wear. Also, there is growing evidence that fumed silica is a key factor contributing to "in-use thickening", or paste formation, of MR fluids in suspension dampers subjected to accelerated durability testing.

An alternative approach to polymeric thickeners and fumed silica, both of which have potential drawbacks in formulating MR fluids, is to use colloidal clay. Using a surface-treated, colloidal organoclay as a stabilizer for MR fluids was first demonstrated and patented in U.S. Pat. No. 6,203,717 by Lord Corporation, and forms part of the package for the MR fluid (B5.2F) which, for example, has been approved for vehicle shock absorber production. In contrast to polymeric thickeners, and similar to fumed silica, an MR fluid with the organoclay will form a light gel at low volume concentrations, with a yield stress sufficient to prevent or significantly retard settling, but with an ability to flow with low to moderate viscosity. Moreover, the clay is inherently less abrasive than fumed silica, suggesting the possibility to reduce expensive surface treatments used to retard or prevent abrasion.

Although organoclay stabilizer systems for other applications (lubricating greases, cosmetics, etc.) are known, and are even being utilized in vehicle applications, there are still significant performance issues impacted by the organoclay which need to be addressed. Essentially, as is the case in any technology which relies heavily on surface chemistry to achieve a desired effect, the particular surface treatment of the organoclay must be chosen carefully to insure compatibility with the liquid phase, as well as to achieve a balance between interactions which contribute to yield stress, and those which contribute to viscosity. It would be highly desirable to achieve a desired level of yield stress independently of viscosity. The method disclosed in the Lord patent (U.S. Pat. No. 6,203,717) of using a single organoclay to achieve stability against settling in a hydrocarbon liquid vehicle, with easy redispersibility of any sediment that does occur, involves trade-offs. To achieve a reasonable yield stress for stabilizing the system, a clay is chosen from among those commercially available products which are compatible with the liquid phase, which in the Lord patent is a non-polar synthetic hydrocarbon. However, for damper fluids with stringent seal swell and volatility requirements, the liquid phase is advantageously a mixture of a non-polar synthetic hydrocarbon and a polar diester. Due to the character of the liquid phase, and the fact that commercially available organoclays are designed to be compatible with a given class of liquids of a given polarity, rather than mixtures, a very short list of compatible materials results. A final material is then chosen on the basis of screening with respect to settling and viscosity. Not surprisingly, the resulting compromise often leaves the system marginalized with respect to a low yield stress, and a moderate viscosity. In addition, the yield stress and/or viscosity is often sensitive to the addition of other required components, such as anti-wear additives and antioxidants, requiring adjustment of the clay level to compensate.

There is thus a need for an organoclay stabilizing system that is compatible with the liquid mixture used in many MR fluids so as to decouple the yield stress and viscosity, allowing the optimizing of each property more or less independently.

SUMMARY OF THE INVENTION

The present invention provides a magnetorheological fluid formulation comprising magnetizable particles dispersed in a liquid vehicle mixture comprising at least two liquid components of different surface functionality and an organoclay stabilization mixture. In accordance with the present invention, at least one organoclay is selected for each liquid vehicle component, each organoclay having a surface chemistry that renders it preferentially compatible with the surface functionality of one of the liquid components relative to its compatibility to the remaining liquid components whereby it is effective to stabilize, or gel, that component. By using the organoclay stabilization mixture of the present invention, the yield stress and viscosity of the MR fluid may be independently controlled, and the magnetizable particles remain suspended in the liquid vehicle. There is further provided a method of making an MR fluid in which liquid vehicle components are blended together, the organoclay mixture is added to the blend, and magnetizable particles are suspended therein, resulting in a stable MR fluid of suitable viscosity and yield stress.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
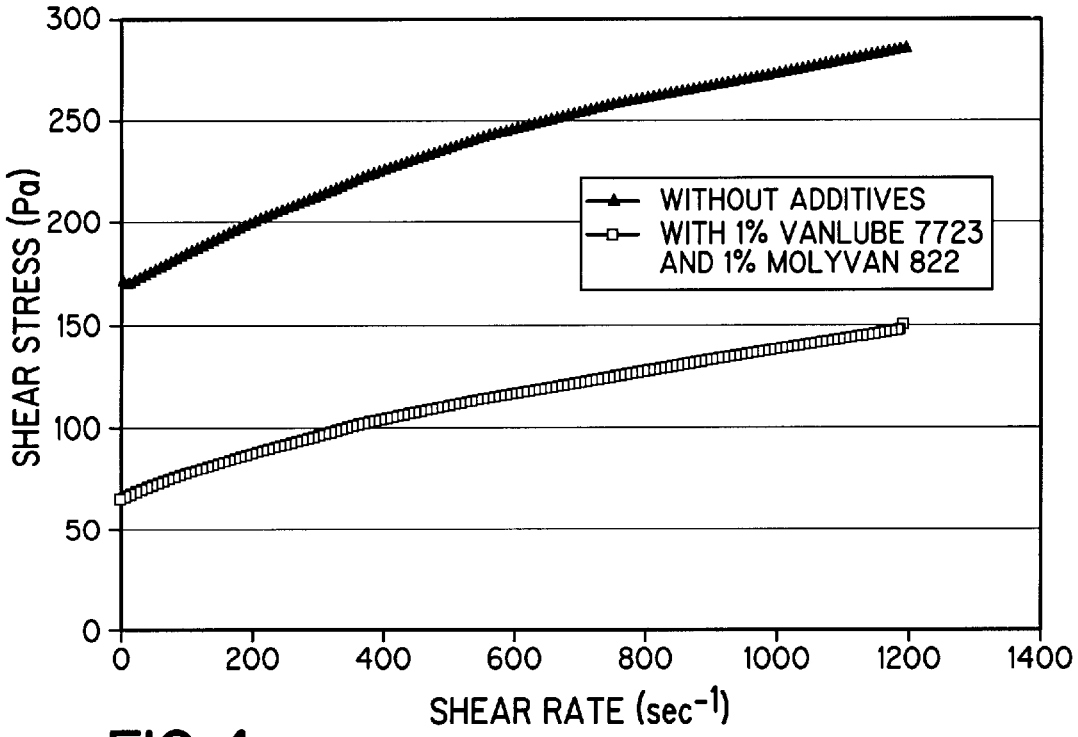
FIG. 1 is a graphical depiction of the effect of additives on MR fluid rheology as expressed by the variation in shear stress with increasing shear rate.

The present invention is directed to an MR fluid formulation in which magnetizable particles are dispersed in a liquid vehicle that comprises at least two liquid components that are miscible yet chemically different. The formulation further comprises a mixture of organoclays, each organoclay having a surface treatment such that it is preferentially compatible with the surface functionality of one of the liquid vehicle components. The mixture of organoclays achieves a decoupling of the yield stress and viscosity of the MR fluid, and further provides synergistic effects in comparison to an MR fluid containing a single organoclay. In the MR fluid formulations of the present invention, for example, a reduction of yield stress due to the addition of anti-wear additives can be minimized or even reversed without an increase in viscosity, by adjusting the ratio of the organoclays, rather than the volume concentration of organoclay.

Naturally occurring clays are inorganic, typically with $Na^+$ ions on the surface. These natural inorganic clays will not thicken organic lubricating oils, such as those used in MR fluids. Organoclays are clays in which the surface is modified to make it organic, by replacing the inorganic $Na^+$ ions with organic surface cations. The gelling properties of organoclays depend largely on the affinity of the organic moiety for the base oil. In accordance with the present invention, in a base fluid mixture, clays with surface organic groups can be chosen to provide compatibility with different fluid chemistries. Thus, the present invention contemplates for each component of the liquid vehicle the selection of an organoclay having a surface treatment that makes it compatible with that liquid vehicle component's surface chemistry, or surface functionality. For example, one liquid vehicle component may have a hydroxyl-functional surface. An organoclay is selected having a surface treatment that exhibits an affinity, or preferential compatibility, with the hydroxyl-functional liquid. If another component in the liquid vehicle has, for example, a chloride-functional surface chemistry, than a second organoclay is selected having a surface treatment that exhibits an affinity, or preferential compatibility, with the chloride-functional liquid. This selection process is carried out for each component of the base liquid vehicle. Thus, for each liquid component, an organoclay is selected that has a stronger affinity for that component than for any other component, i.e., it is preferentially compatible with that component. This selection need not be carried out for additives to the base liquid vehicle, but is intended for the major constituents of the liquid phase of the MR fluid. Another difference in liquid vehicle components that may be used to match the organoclays is polarity. One component of the liquid vehicle may be polar, while a second component is non-polar. Thus, two organoclays are selected, one having a surface treatment that is polar, the other having a surface treatment that is non-polar.

The invention will now be explained in reference to an exemplary application for an MR fluid, specifically a shock absorber in a vehicle. It should be understood, however, that the invention applies to any MR fluid regardless of the application.

By way of example, the magnetizable particles suitable for use in the fluids are magnetizable ferromagnetic, low coercivity (i.e., little or no residual magnetism when the magnetic field is removed), finely divided particles of iron, nickel, cobalt, iron-nickel alloys, iron-cobalt alloys, iron-silicon alloys and the like which are advantageously spherical or nearly spherical in shape and have a diameter in the range of about 1 to 100 $\mu$m. Advantageously, the magnetizable particles are carbonyl or powdered iron. Because the particles are employed in noncolloidal suspensions, it is preferred that the particles be at the small end of the suitable range, preferably in the range of 1 to 10 μm in nominal diameter or particle size. The magnetizable particles may also have a bimodal size distribution. For example, the magnetizable particles may be a mixture of spherical particles in the range of 1 to 100 μm in diameter with two distinct particle size members present, one a relatively large particle size that is about 2 to 10 times the mean diameter of the relatively small particle size component.

The liquid vehicle or liquid carrier phase is a miscible blend of at least two liquid components having different surface chemistries wherein the liquid components are used to suspend the magnetizable particles but do not otherwise react with the particles. Advantageously, the liquid vehicle is a combination of a synthetic hydrocarbon and a synthetic diester. Hydrocarbon liquids, which by virtue of their chemical make-up are essentially non-polar, include but are not limited to mineral oils, vegetable oils, and synthetic hydrocarbons. Polyalphaolefin (PAO) is a suitable base hydrocarbon liquid for shock absorbers as well as many other MR fluid applications in accordance with this invention. However, the polyalphaolefin does not have suitable lubricant properties for some applications including shock absorbers. Therefore, PAO is used in mixture with known lubricant liquids such as liquid synthetic diesters. Examples of diester liquids include dioctyl sebacate (DOS) and alkyl esters of tall oil type fatty acids. Methyl esters and 2-ethyl hexyl esters have also been used. By virtue of their chemical make-up, the diester liquids are essentially polar.

In an exemplary embodiment of the present invention for use in the shock absorber application, the MR fluid formulation comprises about 50–90% by volume PAO, which is the synthetic hydrocarbon of non-polar chemistry, and about 10–50% by volume DOS, which is the synthetic diester of polar chemistry used for lubrication and to optimize seal swell. In a further exemplary embodiment of the present invention, the MR fluid formulation contains PAO and DOS in a ratio of about 80:20 by weight, though this ratio may be adjusted to optimize seal swell, volatility, pour point, viscosity and the like. By way of further example, a 2.5 cst PAO, which consists primarily of dimers of 1-dodecene, has adequate stability in shock absorbers where maximum temperatures do not exceed 100–105° C. However, for other shock absorber devices with continuous use temperatures of 80–100° C. and excursions which can exceed 130–140° C., the 2.5 cst PAO may be too volatile for the higher temperatures. Thus, a higher molecular weight, lower volatility PAO, such as one based primarily on trimers of 1-decene (SHF 41, available commercially from Exxon-Mobile Corp.) or 1-dodecene (Oronite 5, available commercially from Chevron-Phillips Corp.) can be substituted for the 2.5 cst PAO in a base fluid formulation comprising the PAO blended with DOS. Although the higher molecular weight PAO necessarily results in higher base fluid viscosity, the fundamental chemistry of the fluid mixture is virtually identical regardless of whether high or low weight PAO is used, as long as the PAO:DOS ratio remains constant. Of particular importance in the present invention is that PAO and DOS have distinctly different chemistries. One qualitative measure of this difference is that PAO is essentially non-polar, while DOS is relatively polar in nature.

Because PAO and DOS are chemically different, a combination of the two, although miscible, will have a chemistry that reflects the relative composition of the two components. Therefore, an organoclay which stabilizes, or gels, a PAO liquid vehicle would not necessarily do the same, at least not to the same extent, for a blend of PAO and DOS. The concentration of the PAO relative to DOS might have to be substantially increased to achieve gelation in the PAO/DOS mixture, but this would likely result in an unacceptable increase in viscosity of the MR fluid. Likewise, an organoclay which stabilizes, or gels, a DOS liquid vehicle would not necessarily do the same for a mixture of PAO and DOS. Thus, in accordance with the present invention, a combination of organoclays is incorporated in the MR fluid, with one organoclay having a surface chemistry that is preferentially compatible with the surface chemistry of the PAO, and another organoclay with a surface chemistry preferentially compatible with the surface chemistry of the DOS. In other words, one organoclay stabilizes or gels the PAO and one organoclay stabilizes or gels the DOS, resulting in a stabilized mixture. By way of example, an organoclay with a non-polar surface chemistry will readily disperse in the PAO but not in the DOS, while an organoclay with a more polar character will not disperse readily in PAO, but will in the DOS. Thus, a mixture of a non-polar surface treated organoclay and a polar surface treated organoclay may be employed in an MR fluid comprising a non-polar PAO and a polar DOS.

Advantageously, the organoclays are provided in a relative concentration chosen to optimize key suspension properties, such as settling, viscosity, and MR effect. Generally, the organoclay mixture may comprise about 0.25–10% by weight of the liquid vehicle, and each organoclay may comprise about 0.5–15% by weight of its compatible liquid vehicle component. For example, for the 80:20 PAO/DOS mixture, the formulation may comprise about 4 wt. % organoclay mixture, of which about 3.5 wt. % is the PAO-compatible organoclay, and about 0.5 wt. % is the DOS-compatible organoclay.

By way of example and not limitation, Claytone® EM, commercially available from Southern Clay Products, Gonzales, Tex., is a hydrocarbon-compatible non-polar organoclay and thus is preferentially compatible to PAO. Claytone® LS, also commercially available from Southern Clay Products, is an ester-compatible polar organoclay, and thus is preferentially compatible to DOS. In other words, the surface chemistry of the Claytone® EM is such that it exhibits an affinity for the surface functional groups of the PAO. Likewise, the surface chemistry of the Claytone® LS is such that it exhibits an affinity for the surface functional groups of the DOS.

To demonstrate the differences in compatibility of different types of surface treated clay with different types of liquid vehicle components, the two basic fluid constituents of the exemplary shock absorber MR fluid discussed above were tested with the two types of organoclays discussed above. To this end, a series of four base fluids with an organoclay were formulated: (1) Claytone® EM at 3 wt. % dispersed by high shear in SHF 41 PAO; (2) Claytone® EM at 3 wt. % dispersed by high shear in DOS; (3) Claytone® LS at 3 wt. % dispersed by high shear in SHF 41 PAO; and (4) Claytone® LS at 3 wt. % dispersed by high shear in DOS. As evidence of the compatibility of the hydrocarbon-compatible Claytone® EM with the SHF 41 PAO, the 3% Claytone® EM and PAO mixture had the consistency of a light gel, with no syneresis (separation) of fluid from the gelled network. In contrast, the 3 wt. % mixture of the ester-compatible Claytone® LS in the SHF 41 PAO did not gel, but showed a complete separation and sedimentation of the organoclay from the liquid vehicle. The separation and sedimentation is due to the incompatibility of the Claytone® LS surface chemistry with the PAO, whereas the gelling of the Claytone® EM with the PAO is due to the compatibility of its surface chemistry with the surface chemistry of the PAO. Analogous results were obtained for the two DOS mixtures, but now the Claytone® LS evidenced compatibility with the DOS by the formation of a light gel, whereas the Claytone® EM, by virtue of its unfavorable surface chemistry with respect to the diester, showed a tendency to separate and not remain dispersed in the liquid vehicle. Thus, the Claytone® EM is highly compatible with the SHF 41 PAO and not, to any significant degree, with DOS. Likewise, Claytone® LS is highly compatible with DOS, but not with SHF 41 PAO. The Claytone® EM is surface engineered for compatibility with non-polar, synthetic hydrocarbon-like fluids, whereas the Claytone® LS is surface engineered for compatibility with polar di- or mono-esters.

Figure 2:
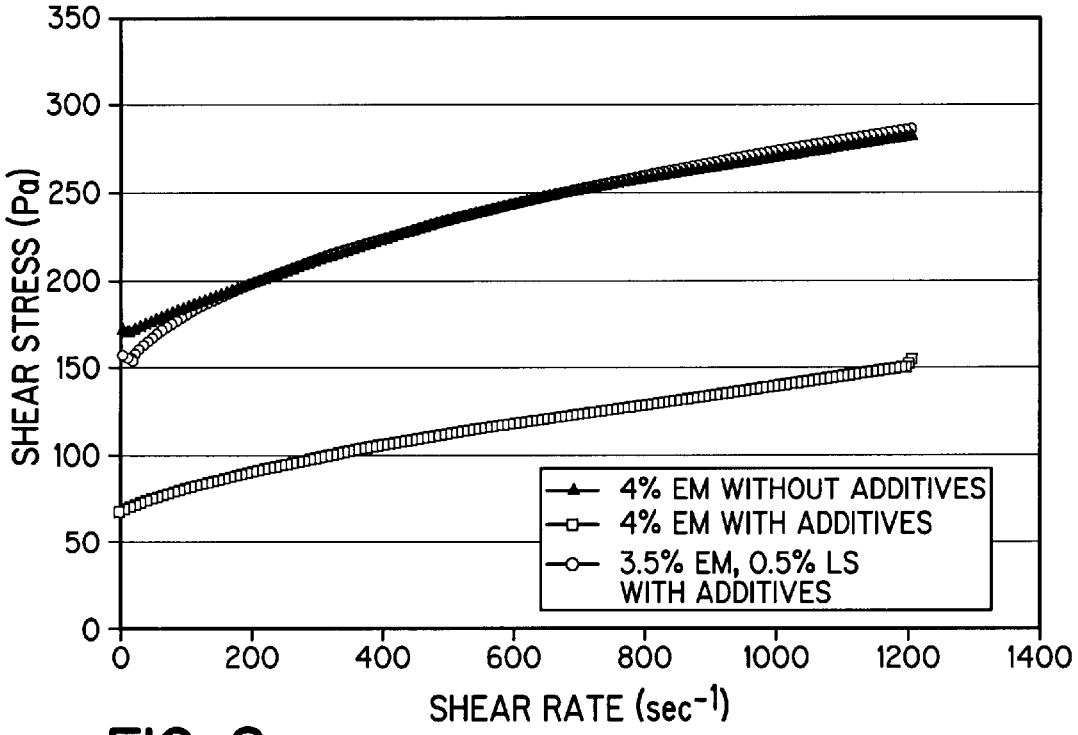
FIG. 2 is a graphical depiction of the recovery of yield stress using an organoclay mixture in accordance with the present invention as expressed by the variation in shear stress with increasing shear rate.

Next, each organoclay was tested in an MR fluid formulation based on a PAO/DOS mixture. For an 80:20 PAO:DOS mixture including Claytone® EM in an amount of 4 wt. % and 22% carbonyl iron by volume, the MR fluid formulation measured a yield stress of about 170 Pa, as shown in FIGS. 1 and 2 at 0 $sec^{-1}$ shear rate, and a viscosity of about 56 cP at 40° C. By changing the relative composition of the PAO:DOS mixture to 60:40, the observed yield stress decreased to about 75 Pa and the viscosity to about 50 cP. Although both of these fluid formulations exhibited excellent stability with respect to settling (high yield stress) and low viscosity, the higher yield stress for the 80% PAO fluid mixture illustrates that the Claytone® EM is preferentially compatible with PAO-type liquids, rather than esters.

Due to the predominance of PAO in the 80:20 PAO:DOS mixture and to a lesser degree in the 60:40 mixture, the Claytone® LS does not provide the same level of yield stress as the Claytone® EM. Using the Claytone® LS by itself to stabilize the PAO:DOS system results in an unacceptably high viscosity. At a level of 2 wt. % Claytone® LS and an 80:20 PAO:DOS fluid formulation with 22% carbonyl iron by volume, the measured viscosity was about 111 cP with a yield stress of about 20 Pa. While it is possible to increase the yield stress by increasing the level of the Claytone® LS, higher levels of that organoclay cause large increases in the viscosity. Consequently. Claytone® LS is not a suitable stabilizer by itself for this two-component type of fluid formulation in which PAO is the predominant liquid component.

Various additives may be included in the MR fluid formulations. For example, in the exemplary shock absorber application, the formulation may include anti-wear and anti-friction additives in the amount of about 0.5 to 3% by volume. Examples of such additives include an organomolybdenum complex, such as Molyvan® 855, an organomolybdenum thiocarbamate, such as Molyvan® 822, and an organothiocarbamate, such as Vanlube® 7723, each of which is available commercially from R.T. Vanderbilt Co., Inc., Norwalk, Conn. Because gelation is dependent on particle-particle interactions, and these in turn are highly dependent on surface chemistry, the presence of additives in the fluid formulation, such as antioxidants and lubricity aids, which can associate with the organoclays or otherwise hinder the clay-clay interactions, can have a marked effect on yield stress and suspension stability. This is illustrated, as seen in FIG. 1, by the reduction of yield stress in the 4% Claytone® EM system discussed above by the addition of 1% Vanlube® 7723 and 1% Molyvan® 822. The original yield stress of about 170 Pa is reduced to about 60 Pa by the presence of the two additives. The strong network in the original fluid formulation is compromised by the additives. Increasing the level of the Claytone® EM to compensate for the reduction of yield stress due to the additives is possible, but the viscosity of the MR fluid will increase to unacceptably high levels, and the magnetic properties of the MR fluid will be compromised. Unfortunately, in the presence of additives, increasing the level of organoclay also increases the viscosity. Consequently, in a single organoclay, additive-containing system, the amount of organoclay cannot be adjusted to compensate for yield stress reduction due to the presence of the additives.

Attempting to recover or reverse yield stress reduction in additive-containing systems by increasing the level of a single organoclay results in an increase in viscosity to an unacceptably high level. A more efficient approach, in accordance with the present invention, is to use a combination of organoclays rather than either type alone, to compensate for the effects of the additives. As illustrated in FIG. 2, yield stress may be substantially recovered without a large increase in viscosity by using a combination of 3.5% Claytone® EM and 0.5% Claytone® LS in the 80:20 PAO:DOS MR fluid formulation. The two types of organoclay in combination provide a synergistic and unexpected result in the properties of the MR fluid formulation. It is also desirable in many applications of MR fluids to be able to independently control or vary the off-state yield stress and viscosity of the MR fluid. In the past, whichever strategy was employed to increase stability, for example increasing the off-state yield stress, would necessarily entail an increase in viscosity. This was demonstrated above in the single organoclay systems. The table below illustrates that by keeping the Claytone® LS concentration constant and increasing the concentration of the Claytone® EM, the viscosity can be maintained constant while the yield stress is increased.

TABLE

| EM/LS Ratio %/% by wt.) | Yield Stress (Pa) | Viscosity (cP) |
|---|---|---|
| 3.0/0.25 | 50 | 59 |
| 3.0/0.5 | 100 | 71 |
| 3.5/0.25 | 100 | 59 |
| 3.5/0.5 | 150 | 67 |

Thus, the present invention allows for the recovery or substantial reversal of the reduction in yield stress caused by the addition of anti-wear and anti-friction additives without significantly effecting viscosity of the MR fluid, and this is achieved without increasing the volume fraction of organoclay in the MR fluid formulation, but rather by simply varying the relative ratio of different organoclays in the fluid.

As stated above, particular mention has been made of shock absorbers for land-based vehicles. Other devices include, but are not limited to: brakes, pistons, clutches, dampers, exercise equipment, controllable composite structures and structural elements. Particular mention has also been made of PAO and DOS, and of Claytone® EM and Claytone® LS as exemplary organoclays having preferential compatibility with PAO and DOS, respectively. It should be understood, however, that there are numerous other liquid vehicle components and organoclays that may be used in accordance with the present invention. It should be further understood that the present invention is not limited to a two-component system. The base liquid vehicle may contain a mixture of two or more liquid components, and an equal number of organoclays are selected, in accordance with the present invention, for preferential compatibility with each liquid component.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A magnetorheological fluid formulation comprising magnetizable particles dispersed in a liquid vehicle mixture comprising at least two liquid components, each liquid component having a different surface functionality, and the formulation further comprising at least one different organoclay for each liquid vehicle component, each organoclay having a surface chemistry which is preferentially compatible with the surface functionality of one of the liquid components relative to its compatibility to the remaining liquid components.

2. The formulation of claim 1 wherein the liquid vehicle mixture comprises a non-polar hydrocarbon liquid component and a polar diester liquid component, and at least one different organoclay includes a non-polar hydrocarbon-compatible organoclay and a polar ester-compatible organoclay.

3. The formulation of claim 1 wherein the liquid vehicle mixture includes a hydrocarbon liquid.

4. The formulation of claim 1 wherein the liquid vehicle mixture includes a polyalphaolefin.

5. The formulation of claim 1 wherein the liquid vehicle mixture includes a diester.

6. The formulation of claim 1 wherein the liquid vehicle mixture includes dioctyl sebacate.

7. The formulation of claim 1 wherein the liquid vehicle mixture includes about 50–90% by volume polyalphaolefin and about 10–50% by volume dioctyl sebacate.

8. The formulation of claim 7 wherein the different organoclay for the polyalphaolefin is present in an amount of about 0.5–15% by weight of the polyalphaolefin and the different organoclay for the dioctyl sebacate is present in an amount of about 0.5–15% by weight of the dioctyl sebacate.

9. The formulation of claim 1 wherein each different organoclay is present in an amount of about 0.5–15% by weight of the liquid component to which it is preferentially compatible.

10. The formulation of claim 1 wherein the organoclays are present in a total amount of about 0.25–10% by weight of the liquid vehicle mixture.

11. The formulation of claim 1 further comprising at least one additive selected from the group consisting of: an organomolybdenum complex, an organomolybdenum thiocarbamate, and an organothiocarbamate.

12. A magnetorheological fluid formulation comprising magnetizable particles dispersed in a liquid vehicle mixture comprising a first liquid component having a non-polar surface functionality and a second liquid component having a polar surface functionality, and the formulation further comprising an organoclay mixture including a first organoclay having a surface treatment that is preferentially compatible with the non-polar surface functionality of the first liquid component and a second organoclay having a surface treatment that is preferentially compatible with the polar surface functionality of the second liquid component.

13. The formulation of claim 12 wherein the first liquid component is a hydrocarbon liquid.

14. The formulation of claim 12 wherein the first liquid component is a polyalphaolefin.

15. The formulation of claim 12 wherein the second liquid component is a diester.

16. The formulation of claim 12 wherein the second liquid component is dioctyl sebacate.

17. The formulation of claim 12 wherein the first liquid component is a polyalphaolefin and the second liquid component is dioctyl sebacate and wherein the liquid vehicle mixture comprises about 50–90% by volume polyalphaolefin and about 10–50% by volume dioctyl sebacate.

18. The formulation of claim 12 wherein the first organoclay is present in an amount of about 0.5–15% by weight of the polyalphaolefin and the second organoclay is present in an amount of about 0.5–15% by weight of the dioctyl sebacate.

19. The formulation of claim 12 wherein the organoclay mixture is present in an amount of about 0.25–10% by weight of the liquid vehicle mixture.

20. The formulation of claim 12 further comprising at least one additive selected from the group consisting of: an organomolybdenum complex, an organomolybdenum thiocarbamate, and an organothiocarbamate.

21. A method of making an MR fluid comprising:

blending a liquid vehicle mixture including at least two liquid components, each liquid component having a different surface functionality;

adding at least one surface-treated organoclay for each liquid component in the liquid vehicle mixture, wherein the surface treatment of each added organoclay renders the organoclay preferentially compatible with the surface functionality of one of the liquid components relative to the compatibility of the organoclay to the remaining liquid components; and dispersing magnetizable particles in the liquid vehicle mixture.

22. The method of claim 21 wherein blending the liquid vehicle mixture comprises blending a non-polar hydrocarbon liquid component and a polar diester liquid component, and wherein adding the organoclay includes adding a non-polar hydrocarbon-compatible organoclay and a polar ester-compatible organoclay.

23. The method of claim 21 wherein a hydrocarbon liquid is blended in the liquid vehicle mixture.

24. The method of claim 21 wherein a polyalphaolefin is blended in the liquid vehicle mixture.

25. The method of claim 21 wherein a diester is blended in the liquid vehicle mixture.

26. The method of claim 21 wherein dioctyl sebacate is blended in the liquid vehicle mixture.

27. The method of claim 21 wherein blending the liquid vehicle mixture includes blending about 50–90% by volume polyalphaolefin with about 10–50% by volume dioctyl sebacate.

28. The method of claim 27 wherein the organoclay for the polyalphaolefin is added in an amount of about 0.5–15%/o by weight of the polyalphaolefin and the organoclay for the dioctyl sebacate is added in an amount of about 0.5–15% by weight of the dioctyl sebacate.

29. The method of claim 21 wherein adding the organoclay includes adding each organoclay in an amount of about 0.5–15% by weight of the liquid component to which it is preferentially compatible.

30. The method of claim 21 wherein adding the organoclay includes adding a total organoclay content of about 0.25–10% by weight of the liquid vehicle mixture.

31. The method of claim 21 further comprising adding at least one additive selected from the group consisting of: an organomolybdenum complex, an organomolybdenum thiocarbamate, and an organothiocarbamate.

* * * * *